United States Patent [19]

Dufrasne et al.

[11] 4,356,359

[45] Oct. 26, 1982

[54] ELECTRICAL APPARATUS COMPRISING A SERIES OF CURRENT TAPS AND VARIABLE SWITCHING GEAR

[75] Inventors: Jean-Claude Dufrasne, Couillet; Jules Thibaut, Mont-sur-Marchienne, both of Belgium

[73] Assignee: Ateliers de Constructions Electriques de Charleroi, Charleroi, Belgium

[21] Appl. No.: 207,880

[22] Filed: Nov. 18, 1980

[30] Foreign Application Priority Data

Nov. 21, 1979 [EP] European Pat. Off. ..... 79200685.0

[51] Int. Cl.[3] ..... H01F 29/04; H01H 1/16; H01H 1/56; H01H 9/00

[52] U.S. Cl. ..... 200/11 TC

[58] Field of Search ..... 200/8 R, 8 A, 9, 11 J, 200/11 K, 11 TC, 239, 240, 244, 248–251, 254, 258, 259, 260, 277, 2

[56] References Cited

U.S. PATENT DOCUMENTS

| | | | |
|---|---|---|---|
| 2,231,627 | 2/1941 | Jansen | 200/9 |
| 2,513,677 | 7/1950 | Rigert | 200/11 B |
| 2,571,794 | 10/1951 | Turner | 200/277 X |
| 2,988,605 | 6/1961 | Van Gent | 200/2 |
| 3,014,999 | 12/1961 | Pensis | 200/11 TC X |
| 3,206,564 | 9/1965 | Hauser | 200/277 X |
| 3,458,670 | 7/1969 | Wittenzellner | 200/11 TC |
| 3,632,908 | 1/1972 | Bleibtreu et al. | 200/11 TC |

FOREIGN PATENT DOCUMENTS

| | | | |
|---|---|---|---|
| 2235333 | 1/1974 | Fed. Rep. of Germany | 200/11 TC |
| 2219220 | 6/1975 | Fed. Rep. of Germany | . |

*Primary Examiner*—James R. Scott

*Attorney, Agent, or Firm*—Schwartz, Jeffery, Schwaab, Mack, Blumenthal & Koch

[57] ABSTRACT

Electrical contact apparatus comprises a center holder supporting a principal roller actuated by a telescopic movement and two oscillating auxiliary holders each equipped with an auxiliary roller.

6 Claims, 10 Drawing Figures

ELECTRICAL APPARATUS COMPRISING A SERIES OF CURRENT TAPS AND VARIABLE SWITCHING GEAR

BACKGROUND OF THE INVENTION

The present invention concerns an electrical apparatus comprising a series of current taps and a variable switching gear equipped with contacts which cooperate with the taps and connected with a circuit comprising at least one transition impedance, together with a link with a principal conductor. The variable switching gear is actuated by a control device. A typical example of such an electrical apparatus with multiple current taps is an electric step transformer equipped with a tap changer that is controlled by a load selector. However, the invention is not limited to transformers but may be applied to other electrical devices, such as compensating coils, banks of resistances or batteries of condensers. The apparatus may be single phase, or it may be designed for multiple phase operation. As in the great majority of cases, the circuits of the switch gear of the switch assemblies of the phases are identical among themselves and are different only when special effects are intended. For purposes of illustration, the description following hereinbelow is limited to the single phase case.

Step transformers with variable switching gears to switch between current taps are well known in the art. In the known transformers, in the course of a switching cycle, a portion of the winding, which is the location of an electromotive force which is to be added or deducted, is short-circuited by one or a plurality of transition impedances located on the variable switch gear and placed into service in one or several intermediate positions of said switch gear. Generally, the different taps consisting of stationary contacts, are electrically connected with the outlets of the control winding and are located, at an adequate dielectric distance from each other, on the internal surface of an insulating cylinder, in the inside of which a variable switch is actuated by a rotating movement around the axis of the cylinder.

In a particular embodiment, the variable switching gear consists of three rows of rollers. The center row consists of a plurality of principal rollers which assure the passage of the current when the variable switch is at rest in front of a stationary contact, while the end rows consist of a single auxiliary roller serving to insert transition impedances when the variable switch is being displaced and to make possible commutation without interruption of the current.

According to the presently known embodiments the three rows of rollers are mounted on the mobile holders of a telescopic or an oscillating movement with a spring device providing an adequate pressure on the rows of rollers against the stationary contacts.

These known embodiments have several disadvantages. In the case of variable gear supported by terminal holders with a telescopic movement, the direction wherein the impact between the auxiliary roller supported by the terminal holder and the stationary contact toward which the variable gear is moving, is strongly oblique with respect to the axis of the slide insuring the telescopic movement. The result is the rapid wear of the device capable of severely interferring with the satisfactory operation of the entire apparatus.

Furthermore, in these embodiments, the lateral placement of the three rows of rollers reduces the dielectric distance with respect to the stationary contact adjacent to the contact in front of which the variable gear is stopped and limits the number of stationary contacts on a given circumferential length.

SUMMARY OF THE INVENTION

The present invention overcomes the disadvantages of the prior art. The invention is characterized by that the two end holders oscillate from one side to the other of their rest position by an angle that may be variable. The inclination of the terminal holders reduces the lateral space required by the switch gear at the level of the rollers and it consequently increases the number of contacts distributed over the circumferential length and permits the use of a control winding with a greater number of intermediate outlets. Furthermore, the oscillation of the end holders from one side of their rest position to the other allows the auxiliary roller to give way easily when on the stationary contact. This arrangement considerably reduces the effect of the high velocity impact of the auxiliary roller on the stationary contact toward which the variable gear is moving.

For each end holder, the contact pressure of the auxiliary rollers on the stationary contact and its return into the position of rest are obtained by means of a device equipped with one or a plurality of springs. The auxiliary roller has the function of cutting the circulating current established at the instant the two end holders are in simultaneous contact with successive stationary contacts. This particular arrangement lends the auxiliary roller, a high cutting velocity by adding to the velocity of the moving gear, the velocity imparted by the return device of the end holder. This characteristic reduces the electrical wear of the auxiliary rollers intended to cut the circulating current which in certain cases may be as high as the line current.

BRIEF DESCRIPTION OF THE DRAWINGS

The invention shall be described hereinbelow with reference to an example of embodiment represented in the following figures.

DETAILED DESCRIPTION OF THE PREFERRED EMBODIMENT

Figure 1:
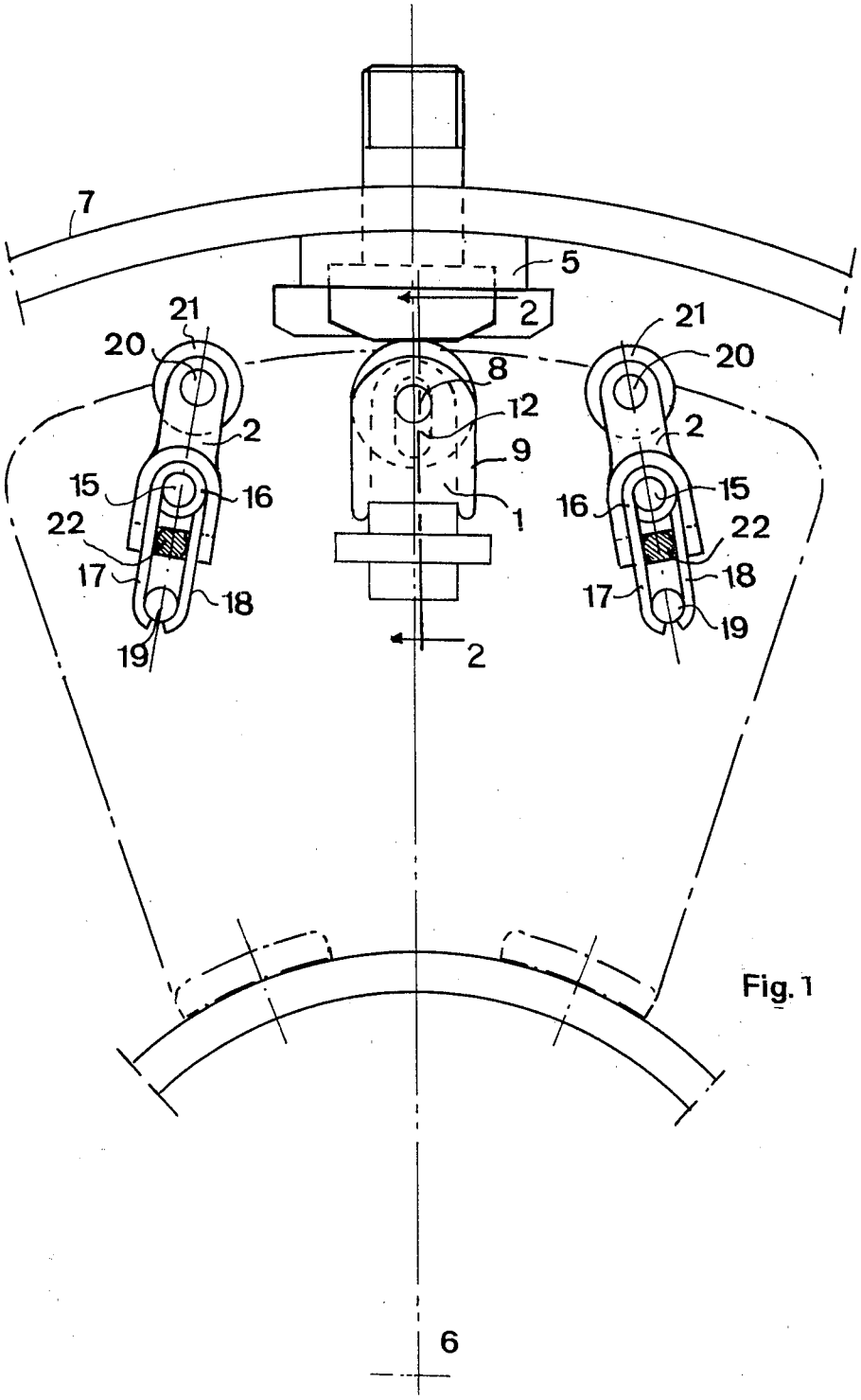
FIG. 1 is a top view of the variable gear shown in the position of rest. The variable switch gear consists of a central holder and two end holders.

In FIG. 1, showing the switch gear in its rest position a center holder 1, which is made of a material with good electrical conductivity, is at the center of a stationary contact 5. End holders 2, also made of electrically conductive material are in their position of rest.

The entirety of this variable gear pivots around an axle 6 of a cylinder 7 upon which the stationary contact 5 is positioned.

Figure 2:
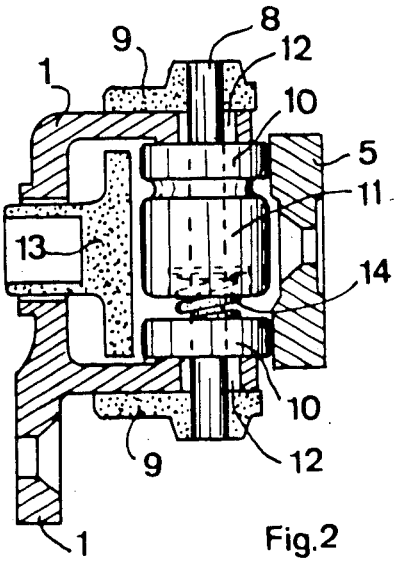
FIG. 2 is a partial cross section of the center holder taken along section line 2—2 of FIG. 1.

FIG. 2 illustrates the center holder 1 of the variable gear at rest, and is taken along line 2—2 of FIG. 1. An axle 8, maintained at each end in a guide 9 of an insulating material, supports two principle rollers 10 made of copper, an interrupting roller 11 made of a copper-tungsten alloy and a slide in a stud-hole 12. A piston 13 of an insulating material, pressured by a spring, not shown, biases the principal rollers 10 against the stationary contact 5 with an adequate pressure. A spring 14, coaxial with the axle 8 assures the continuity of the electrical circuit by urging the copper flanks of the principal rollers 10 against the holder 1.

Figure 3:
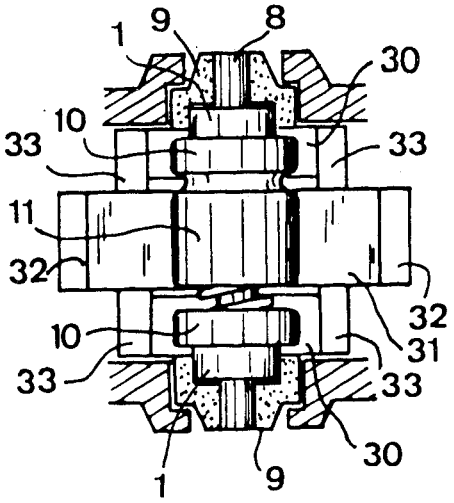
FIG. 3 is a front elevation of the center holder.

FIG. 3 is a view in elevation of the center holder 1 when arrested on the stationary contact 5. The stationary contact 5 consists of two plates 30, made of a material with good electrical conductivity and located on either side of a center plate 31 of a material resistant to electric arcs. The center plate 31 is placed in a plane that is retracted with respect to the plane of the plates 30. Further, the center plate 31 is longer than the plates 30 and it terminates at each end in an inclined plane 32 (away from the plane of the figure) which facilitates the access and departure of the interrupting roller 11. Each plate 30 of a material with good electrical conductivity terminates further at each end in an inclined plate 33 which facilitates the access and departure of the principal rollers 10. When the variable gear leaves the stationary contact 5, the principle roller 10 rolls on the plates 30 and then on the inclined planes 33. When the principal roller 10 leaves the inclined plane 33, the interrupting roller 11 in turn is able to roll on the track 31 and then on the inclined plane 32. In this manner, the cutting of the current carried by the stationary contact 5 is effected at the level of the inclined plane 32 and the interrupting roller 11, both made of a material resistant to electric arcs.

Figure 4:
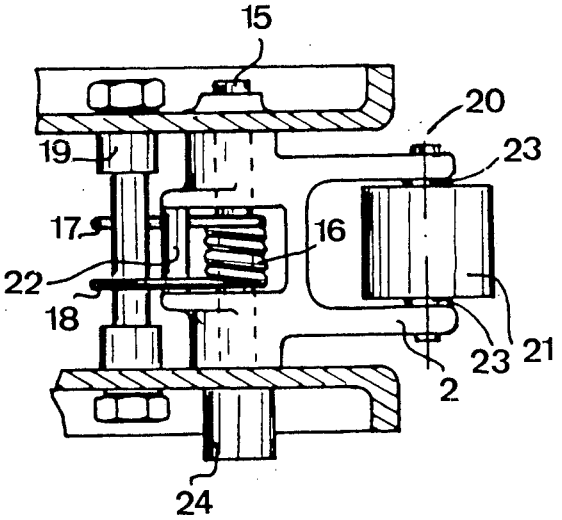
FIG. 4 is a side view of an end holder.

In FIG. 4, representing an example of embodiment of an end holder 2 at rest, the rotation of the holder 2 is assured by means of an axle 15. A torsion spring 16, coaxial with the axle 15, terminates at each end in a blade 17 and 18 shaped to rest on a brace 19 integral with the moving gear. One end of the holder 2 supports an axle 20 around which an auxiliary, copper-tungsten alloy roller 21 pivots, while the other end of the holder terminates in a bar 22, which in its rest position, is aligned with the axle 15 and the brace 19. Following the displacement of the moving gear, the auxiliary roller 21 enters into contact with the stationary contact 5. The holder 2 pivots around the axle 15, and blade 17 of the torsion spring 16 rests on the brace 19. At the same time blade 18 is biased by the bar 22 of the holder 2, deviating from its normal position. The resulting elastic deformation of the torsion spring 16 insures that there will be a good contact pressure between the roller 21 and the stationary contact 5.

During a displacement of the moving gear in the reverse direction, the blades 17 and 18 respectively, travel in the reverse direction, in the manner described hereinabove. The use of the torsion spring 16 as the device returning the holder 2 renders the contact pressure between the auxiliary roller 21 and the stationary contact 5 proportional to the angle by which the holder 2 deviates from its rest position.

In the case of small deviations of the holder 2 with respect to its normal rest position, excessively low contact pressures may be compensated by the combined use of other tension, compression or torsion springs.

In order to insure the continuity of the electric circuit, a corrugated washer 23 of a material with good electrical conductivity, is introduced between the auxiliary roller 21 and each arm of the holder 2. The current thus may be carried from the auxiliary roller 21 to a current tap 24.

When the auxiliary roller 21 leaves the stationary contact 5, the spring 16 returns the holder 2 into its position of rest.

Figure 5A:
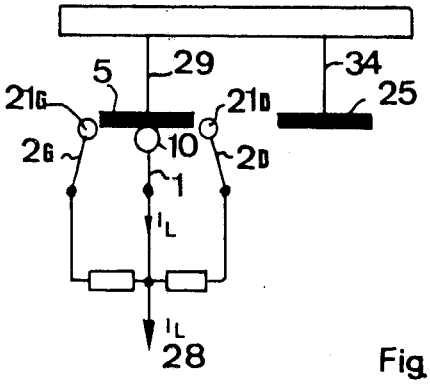
FIGS. 5A–5F show schematically the different positions occupied by the moving gear when passing from one stationary contact to another.

FIGS. 5A–5F show the different positions occupied by the moving gear in passing from the stationary contact 5 to another stationary contact 25. FIG. 5A shows the moving gear at rest on the stationary contact 5. The holder 1, which supports the principal rollers 10 is in the center of the stationary contact 5 and carries the line current $I_L$ at the voltage of the tap 29, from the stationary contact 5 to a principal conductor 28. The end holders 2, supporting the auxiliary rollers 21, are designated respectively 2G and 21G for the holder and the auxiliary roller located to the left of the center holder, and 2D and 21D for the holder and auxiliary roller located to the right of the center holder. Through the principal rollers 10 and the center stirrup 1, the end stirrups 2G and 2D and the auxiliary rollers 21G and 21D are at the potential of the tap 29.

Figure 5D:
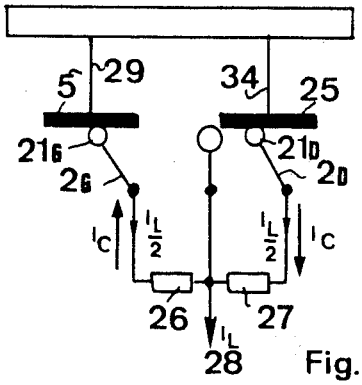
Figure 5B:
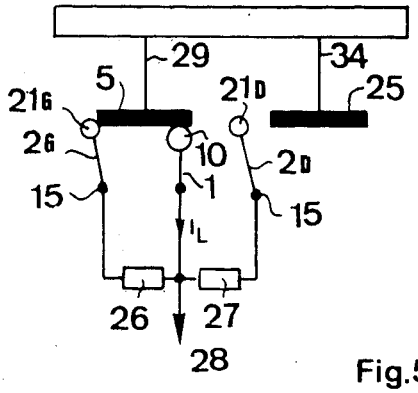

When the driving device displaces the moving gear to the right, as shown in FIG. 5B, to pass from the stationary contact 5 to the next stationary contact 25, the auxiliary roller 21G comes to stop against the stationary contact 5 and the holder 2G pivots around the axle 15. The electric circuit connecting the stationary contact 5 with the principal conductor 28 is forced by two parallel branches having unequal resistances. The branch of the end stirrup 2G wherein the impedance 26 is inserted, does not conduct the current, while the branch of the center holder 1 with practically zero resistance, continues to carry the line current $I_L$ from the stationary contact 5 to the principle conductor 28.

Figure 5E:
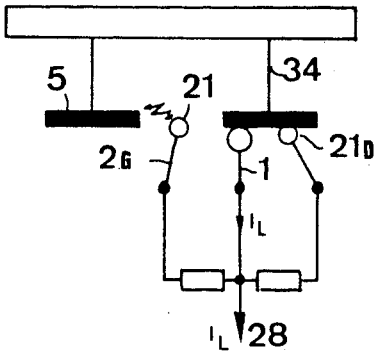
Figure 5C:
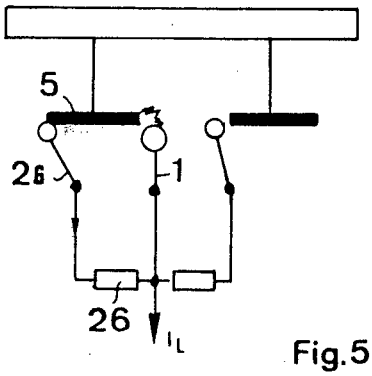

FIG. 5C shows the moving gear at the instant when the center holder 1 has left the stationary contact 5 thus cutting the line current $I_L$. The line current $I_L$ is then passed through the branch of the end holder 2G across the impedance 26.

FIG. 5D shows the moving gear when the auxiliary roller 21D of the end holder 2D reaches the stationary contact 25, while the auxiliary roller 21G of the end holder 2G has not yet left the stationary contact 5. In practice, one half of the line current $I_L$ coming from the principal conductor 28 is conducted by the branch containing the auxiliary roller 21G, the end holder 2G and the impedance 26, while the other half of the line current passes through the branch comprising the auxiliary roller 21D, the end holder 2D and the impedance 27. Assuming that the potential of the tap 34 connecting the stationary contact 25 is higher than the potential of the tap 29 connecting the stationary contact 5, a circulating current $I_C$ is established, passing from the stationary contact 25 toward the stationary contact 5, successively through the auxiliary roller 21D the holder 2D, the impedances 27 and 26, the holder 2G and the auxiliary roller 21G.

In FIG. 5E, the end holder 2G has left the stationary contact 5 and the auxiliary roller 21G has cut the abovementioned circulating current. The line current $I_L$, at the potential of the tap 34, is again carried by the center holder 1 from the stationary contact 25 to the principal conductor 28.

Figure 5F:
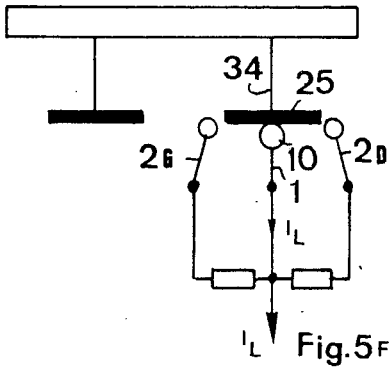

FIG. 5F shows the moving gear at rest in front of the stationary contact 25. Through the principal roller 10 and the center holder 1, the end holders 2G and 2D and the auxiliary rollers 21G and 21D are at the potential of the tap 34.

What is claimed is:

1. An electrical contact apparatus comprising:

an insulating support upon which a row of stationary contacts is arranged, each stationary contact comprising at least one rolling surface;

a control slide mounted for parallel movement with respect to the row of stationary contacts;

an assembly of three moving contacts mounted on the control slide, comprising: a center strap telescopically mounted to said control slide, two end straps, each of said center and end straps being equipped with at least one associated roller capable of rolling on at least one surface of said stationary contacts, and means for mounting said end straps to said control slide such that the distance between said end straps varies laterally with respect to said center strap in response to said associated rollers of said end straps contacting a rolling surface of a stationary contact during movement of said control slide, and two impedances mounted on said control slide connecting said end straps, respectively, with said center strap.

2. An electric contact apparatus as set forth in claim 1, wherein said insulating support is cylindrically shaped and said stationary contacts are distributed along an inner periphery thereof, said control slide being mounted on a control shaft, said control shaft being mounted for coaxial rotation within said insulating support, and further wherein each said stationary contact is made of a conductive material and comprises three contact bands terminating in inclined planes, two of said bands being short bands terminating in inclined planes and located on either side of the third band being a long band which terminates in inclined planes, said long band being formed of a material resistant to electrical arcs and being located in a recess with respect to said short bands, said center strap being made of conductive material, and said telescopic mount for said center strap comprising an axle supporting said center strap, and two slides mounting said axle to permit longitudinal movement thereof, said slides being formed of insulating material, and further wherein three rollers of the same diameter are threaded on said axle, said three rollers comprising a center roller formed of a material resistant to electrical arcs, and two additional rollers positioned on each side of said center roller, and an insulative piston spring biased against said three rollers whereby said rollers are urged to move with said axle in said slots, and further including a spring threaded on said axle between said center roller and one of said additional rollers whereby said additional rollers are urged against internal walls of said center strap, and wherein each end strap is formed of conductive material, and wherein said mounting means comprises a mounting axle associated with each end strap for pivotally mounting the associated end strap and means for biasing the associated end strap in a predetermined direction on said first mounting axle.

3. An electrical contact apparatus as described in claim 1, wherein:

said insulating support is an insulating cylinder and said stationary contacts are mounted on one periphery thereof;

said control slide is mounted on a control shaft which is rotatably mounted coaxially with said insulating cylinder;

each stationary contact is formed of a good conductor material and comprises three contact bands terminating in inclined planes, of said three bands, two short bands terminate in inclined planes and are located on either side of a long band which terminates in inclinded planes, said long band being made of a material resistant to electrical arcs and located in the same plane as the short bands; said center strap is formed of a good conductor material and supports an axle maintained in two slides, said slides being formed of an insulating material and being capable of movement longitudinally of said center strap, three rollers being threaded on said axle, said rollers being a center roller having a small diameter and two end rollers having larger diameters than said center roller, said end rollers being formed of a good conductor material and being designated the principal rollers, said center roller being of a material resistant to electrical arcs and being designated the breaker roller, said three rollers being urged longitudinally of said center strap by a spring biased insulating piston sliding in said center strap, a spring threaded onto said axle between one of said principal rollers and said breaker roller whereby said principal rollers are urged against inner walls of said center strap; and each end strap is formed of a good conductor material, and said mounting means includes a mounting axle which pivotally mounts the associated end strap, and means for biasing each end strap in a predetermined position.

4. An electrical contact apparatus as described in claim 2 or 3, wherein said biasing means includes at least one spring mounted on said mounting axle and having ends resting against a brace.

5. An electrical contact apparatus as set forth in claim 4, and further including eccentric means for modifying the angular deflection of each end strap.

6. An electrical contact apparatus as set forth in claim 4, and further including terminal stops for defining the angular deflection of said end straps, and means for adjusting the position of said terminal stops.

* * * * *